US008783275B2

(12) United States Patent
David

(10) Patent No.: US 8,783,275 B2
(45) Date of Patent: Jul. 22, 2014

(54) COMPACT FOLDING UMBRELLA WITH HYBRID RIBS TO RESIST DAMAGE DUE TO INVERSION

(71) Applicant: Kahng J. David, New York, NY (US)

(72) Inventor: Kahng J. David, New York, NY (US)

( * ) Notice: Subject to any disclaimer, the term of this patent is extended or adjusted under 35 U.S.C. 154(b) by 0 days.

(21) Appl. No.: 13/749,973

(22) Filed: Jan. 25, 2013

(65) Prior Publication Data

US 2013/0228203 A1 Sep. 5, 2013

Related U.S. Application Data

(63) Continuation of application No. 12/962,155, filed on Dec. 7, 2010, now Pat. No. 8,360,082.

(60) Provisional application No. 61/282,782, filed on Mar. 31, 2010.

(51) Int. Cl.
*A45B 25/00* (2006.01)

(52) U.S. Cl.
USPC ..... 135/31

(58) Field of Classification Search
USPC ..... 135/31
See application file for complete search history.

(56) References Cited

U.S. PATENT DOCUMENTS

| | | | | |
|---|---|---|---|---|
| RE21,492 | E * | 6/1940 | Okun | 135/25.31 |
| 2,221,289 | A | 11/1940 | Okun | |
| 4,734,126 | A | 3/1988 | Sweet, Jr. | |
| 5,121,764 | A | 6/1992 | Wu | |
| 5,502,624 | A | 3/1996 | Tu | |
| 5,553,634 | A | 9/1996 | Yang | |
| 5,931,175 | A | 8/1999 | Lin et al. | |
| 6,062,242 | A | 5/2000 | Lin | |
| 6,095,169 | A | 8/2000 | Lin et al. | |
| 6,230,725 | B1 | 5/2001 | Ko | |
| 6,394,115 | B1 | 5/2002 | Tseng | |
| 6,497,242 | B1 * | 12/2002 | Lin et al. | 135/31 |
| 6,626,198 | B2 | 9/2003 | Tseng | |
| 6,668,845 | B2 | 12/2003 | Lin et al. | |
| 6,863,081 | B2 * | 3/2005 | Hsieh | 135/29 |
| 2002/0129843 | A1 | 9/2002 | Wang | |
| 2005/0211283 | A1 | 9/2005 | Lai | |
| 2007/0204894 | A1 | 9/2007 | Huang | |

* cited by examiner

*Primary Examiner* — Noah Chandler Hawk
(74) *Attorney, Agent, or Firm* — Millen, White, Zelano & Branigan, P.C.

(57) ABSTRACT

A folding umbrella and particularly one having multiple folds, includes a support frame incorporating a hybrid rib typically located intermediate a main rib and a rear or outermost rib. The hybrid rib is formed of multiple sections composed of first and second materials which respectively provide the desired structural strength to reduce inversions of the umbrella to an acceptable minimum and provide the hybrid rib with the desired resiliency and flexibility to return the hybrid rib to its original, unstressed shape and thereby prevent permanent damage to the hybrid rib as well as adjoining frame elements of the umbrella. The thicknesses of the multiple sections and the relative sizes of the sections also significantly contribute to the capability of the hybrid rib to achieve the desired objectives of a compact, small, folding umbrella of reduced weight, and the ability to prevent permanent damage to the frame due to inversion.

11 Claims, 2 Drawing Sheets

COMPACT FOLDING UMBRELLA WITH HYBRID RIBS TO RESIST DAMAGE DUE TO INVERSION

CROSS REFERENCE TO RELATED APPLICATION

This application claims the benefit of U.S. Provisional Application No. 61/282,782, filed on Mar. 31, 2010, and the utility application Ser. No. 12/962,155 which is incorporated by reference as if fully set forth.

FIELD OF INVENTION

The present invention relates to a compact, light-weight folding umbrella able to withstand bending without breaking and more particularly to a folding umbrella provided with ribs having a hybrid structure which significantly increase the structural strength of the umbrella without increasing the weight and size of the folding umbrella.

BACKGROUND

Compact, folding rain umbrellas and, more particularly, multiple fold umbrellas have a more complex frame structure, composed of many ligaments or ribs, as compared with foldable umbrellas having only a single fold. Folding umbrellas are particularly susceptible to breakage, especially those of the multiple fold design. Even a moderate wind force acting on the protective fabric of the umbrella will force the umbrella to invert since the force, although moderate, acts on a large surface area, much like the sail of a boat. This force is transferred to the frame structure supporting the protective fabric, causing the ribs to bend as they absorb this force. Ribs formed entirely of a non-elastic alloy, such as aluminum or steel, which experience such bending, remain distorted due to their lack of resilience and do not return to their original unbent shape, and thereby distort the entire support frame and degrade the normally smooth opening and closing operations of the umbrella. On the other hand, forming ribs of a material which is too flexible yields an umbrella which will invert too easily making it cumbersome and annoying to the user. The above problems affect all folding umbrellas and are more severe in the case of the multiple fold category.

Therefore, a design is needed to provide ribs having a proper balance of rigidity and flexibility sufficient to reduce inversion to an acceptable minimum, while providing sufficient elasticity to return the ribs back to their original shape in the event of an inversion.

OBJECTS OF THE INVENTION

One object of the present invention is to provide ribs for a compact, folding umbrella and especially a multiple-fold umbrella, which have a hybrid structure comprised of two different materials that cooperate to provide ribs having the strength and rigidity to minimize inversions to an acceptable level and the resilience to return the hybrid ribs to their original shape without experiencing permanent distortion.

Another object of the present invention is to provide ribs for a compact, folding umbrella which incorporates a hybrid structure comprised of first and second interconnected components which are respectively formed of aluminum of a size, shape and thickness to provide composite ribs having the strength and rigidity needed to minimize inversions and fiberglass of a size and shape needed to provide the elasticity necessary to return the rib back to its original shape and state without experiencing permanent distortion due to bending.

SUMMARY

In one preferred embodiment a compact, multiple fold umbrella is comprised of a support frame incorporating a hybrid rib typically located intermediate a main rib and a rear or outermost rib. The hybrid rib is formed of multiple sections composed of first and second materials which respectively provide the desired structural strength to reduce inversions of the umbrella to an acceptable minimum and provide the hybrid rib with the desired resiliency and flexibility to return the hybrid rib from a bent shape to its original unstressed shape and thereby prevent permanent damage to the hybrid rib as well as adjoining frame elements of the umbrella. The thicknesses of the multiple sections and the relative sizes of the sections also significantly contribute to the capability of the hybrid rib to achieve the desired objectives of a compact, small, folding umbrella of reduced weight, and the ability to prevent permanent damage to the frame due to inversion.

BRIEF DESCRIPTION OF THE DRAWINGS

The above as well as other objects and advantages of the present invention will become apparent upon reading the accompanying description and drawings in which.

DETAILED DESCRIPTION OF THE PREFERRED EMBODIMENTS

Figure 1:
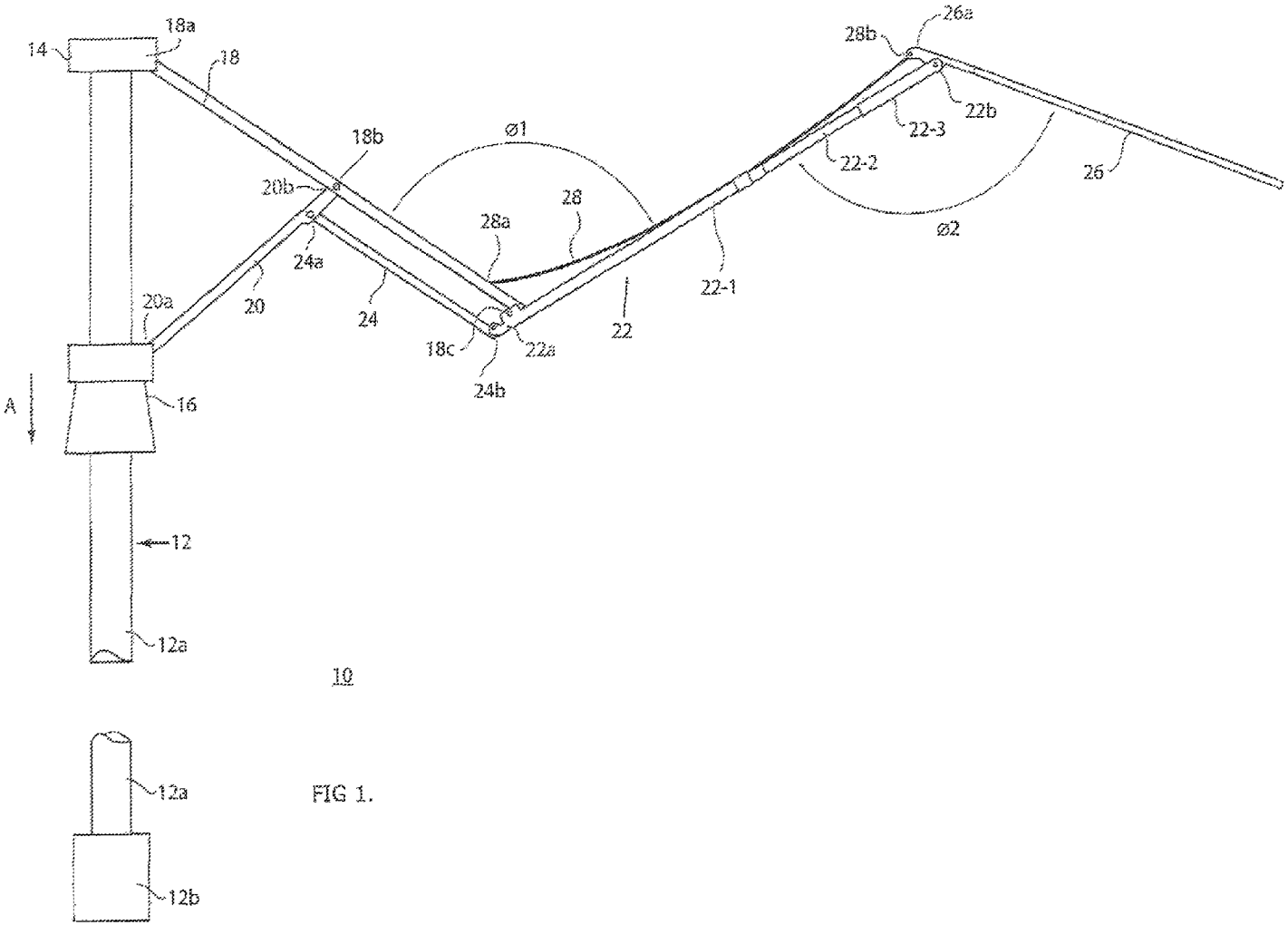
FIG. 1 is a perspective view of a folded umbrella frame of the present invention showing the frame in the unfolded, open position.

FIG. 1 shows a simplified view showing the principal elements of a compact, light-weight, foldable umbrella 10 embodying the principles of the present invention and with the rain-protecting fabric (not shown) removed to facilitate a clear understanding of the invention and its novel features and advantages.

The foldable umbrella 10 is comprised of a main shaft 12. The lower end 12*a* is typically provided with a handle (12*b*) at the lower end and configured to facilitate gripping of the umbrella during use. An annular cap 14 is provided at the top end of shaft 12. Shaft 12 extends through a hollow, annular collar 16, typically referred to as a runner, which is slidable along main shaft 12. A first main stretcher 18 has its left-hand end 18*a* pivotally coupled to cap 14. A support stretcher 20 has its left-hand end 21*a* pivotally coupled to slidable collar 16 and has its opposite end 20*b* pivotally coupled to a midpoint 18*b* of main stretcher 18. The right-hand end 18*c* of main stretcher 18 is pivotally coupled to the left-hand end 22*a* of a second main stretcher forming a hybrid rib 22. The left-hand end 24*a* of secondary support stretcher 24 is pivotally coupled at a point inward from end 20*b* of support stretcher 20 and the fight-hand end 24*b* of secondary support stretcher 24 is pivotally coupled to the left-hand 22*a* end of hybrid rib 22. The right-hand end 22*b* of rib 22 is pivotally coupled to rear rib 26 at a point located inward from end 26*a* of rear rib 26. A flexible member 28 has its left-hand end 28*a* pivotally coupled to main stretcher 18 at a point inward from the right-hand end of main stretcher 18 and its right-hand end 28*b* pivotally coupled to end 26*a* of rear rib 26. When the umbrella frame is opened, angle Ø1 formed between elements 18 and 22 increases, pulling element 28 to the left relative to the hybrid rib 22, causing flexible member 28 to rotate counter-clockwise about a pivot pin coupling elements 22 and 26, thereby increasing the angle Ø2 between hybrid rib 22 and rib 26 and moving the umbrella frame 10 to the fully open position.

In one embodiment, umbrella 10 is folded, i.e., collapsed, by moving collar 16 downward relative to shaft 12 in the direction of arrow A and against the opening force of a spring (not shown for purposes of simplicity) contained within shaft 12 and thereby causing all of the stretchers, supports and ribs to move next to and substantially in parallel with the longitudinal central axis of shaft 12, providing an umbrella which is compact and easy to handle and store. The angle 01 reduces toward zero, causing flexible member 26 to move to the right relative to hybrid rib 22, rotating element 26 clockwise about its pivot pin and reducing 02 to zero to collapse the umbrella frame.

In another embodiment, umbrella 10 is folded by releasing a locking mechanism (not shown) arranged between collar 16 and shaft 12, enabling collar 16 to move downward relative to shaft 12 in the direction of arrow A under the opening force of a spring (not shown for purposes of simplicity) contained within shaft 12 and thereby causing all of the stretchers, supports and ribs to move next to and substantially in parallel with the longitudinal central axis of shaft 12, likewise providing an umbrella which is compact and easy to handle and store.

Both of the embodiments described above undergo multiple folds, namely a first fold between main shaft 12 and main support stretcher 18, a second fold between main support stretcher 18 and rib 22 and a third fold between rib 22 and rear rib 26, opposing ends of rib 22 being joined to adjacent elements to form the two folds of the umbrella. This design significantly reduces the length of the umbrella frame, and hence the umbrella, when in the collapsed condition, as compared with folding umbrellas experiencing only a single fold. The reduced length of the multiple-fold umbrella comes at the expense of requiring more frame components which must be designed to provide structural strength equivalent to single-fold umbrellas and without significantly increasing the weight of the umbrella frame.

To provide a foldable umbrella which is both light-weight and compact, the stretchers, supports and ribs are designed to at least partially nest into or be nested by one of the neighboring components that comprise the support frame, it being understood that the protective fabric is secured to the frame at limited points thereof and surrounds the frame when in the collapsed condition.

The stretchers and supports and portions of the ribs which comprise the umbrella frame have a substantially U-shaped configuration which serves the dual functions of increasing the structural strength through the use of the U-shaped portions and facilitating nesting and/or compactness of these components when in the folded condition.

It is also important to select the thicknesses of these components in order to provide a folding umbrella that is both light-weight and compact, while providing the necessary structural strength and flexibility to prevent forces, such as wind, which invert the open umbrella, from subjecting the umbrella frame from experiencing permanent distortion and damage.

The materials typically employed in folding umbrellas, and their advantages and disadvantages, are:

ALUMINUM: Although aluminum is a light-weight metal and is capable of producing inexpensive frame components, an all-aluminum rib has the disadvantage of being easily distorted when subjected to bending and not return to is original shape when the force causing bending is removed, thereby causing permanent damage to all aluminum components.

STEEL: Like aluminum, an all-steel rib will remain distorted after the umbrella inverts, since steel will remain distorted if the rib is bent due to wind force. Steel has the disadvantage of being significantly heavier than aluminum and is less resistant to corrosion than aluminum.

PLASTIC: All-plastic ribs offer some flexibility, but lack the strength of metal alloys. All-plastic ribs or partial plastic ribs are more likely to break or snap when stressed by wind force.

CARBON FIBER: Carbon fiber is made of thin strands of carbon, while fiberglass is made of glass textile fiber. Although ribs composed entirely or partially of carbon fiber is more resilient than plastic, carbon fiber is much stiffer and less flexible than fiberglass. A rib fully or partially composed of carbon fiber lacks the flexibility of the Aluminum/Fiberglass combination rib. In addition, carbon fiber costs are substantially higher to produce than fiberglass.

Figure 2:
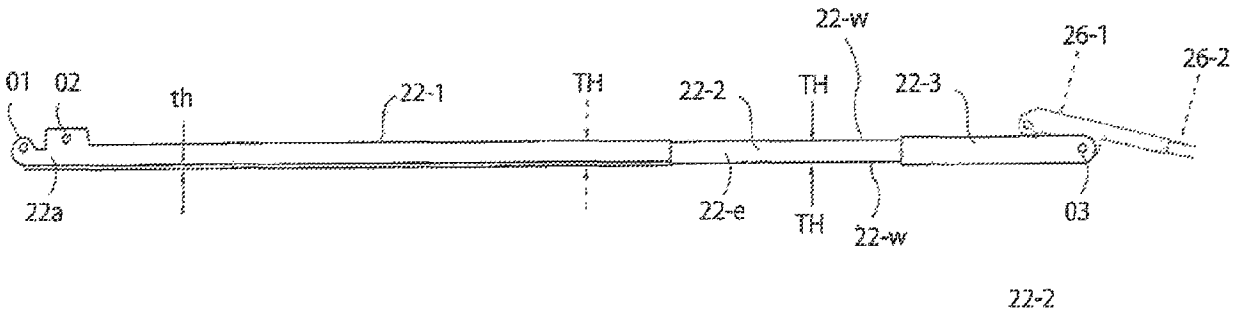
FIG. 2 is a side profile view of a rib design according to the invention and employed in the frame shown in FIG. 1.
Figure 3:
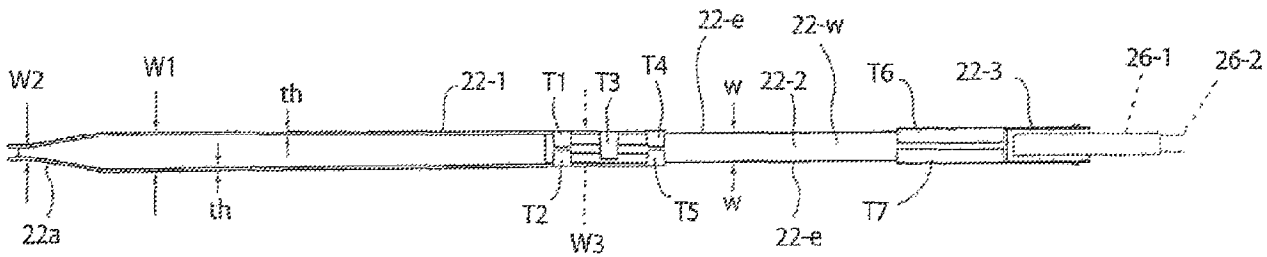
FIG. 3 is a top view of the rib design shown in FIG. 2.
Figure 4:
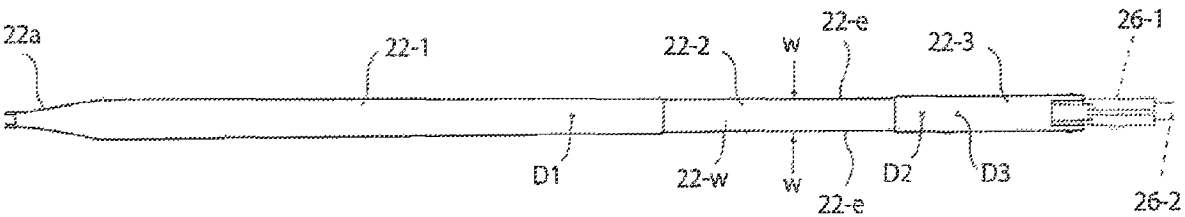
FIG. 4 is a bottom view of the rib design shown in FIG. 2.

Rib 22 is the structural element which is the most vulnerable to being permanently damaged due to inversion. The present invention replaces a conventional rib, typically formed of a light-weight metal, with a hybrid rib 22 that has been designed to prevent permanent damage due to inversion. The hybrid rib 22, shown best in FIGS. 2-4, is composed of three components 22-1, 22-2 and 22-3. Components 22-1 and 22-3 define opposing end sections of the hybrid rib and are formed of a suitable aluminum alloy. Component 22-2 is an intermediate section formed of fiber glass reinforced plastic. The aluminum sections 22-1 and 22-3 are significantly lighter in weight than steel and more resistant to corrosion. Fiberglass reinforced plastic section 22-2 provides the desired flexibility without experiencing the breakage occurring when using ordinary plastic. Although ribs composed entirely or partially of carbon fiber are more resilient than plastic, carbon fiber is much stiffer and less flexible than fiberglass. A rib fully or partially composed of carbon fiber lacks the flexibility of the hybrid rib of the present invention. In addition, the cost of producing carbon fiber is substantially greater than the cost of producing fiberglass reinforced plastic.

Section 22-2 is comprised of a fiber glass reinforced plastic having fiber glass fibers embedded in the plastic material. Section 22-2, in one embodiment, preferably has a rectangular cross-section with its thickness being less than its width as will be described below in greater detail.

Sections 22-1 and 22-3 are hollow, elongated sections with U-shaped having wall thicknesses "th" set forth in paragraph [0039]. The free end of section 22-1 defines the left-hand end of hybrid rib 22 and tapers from a width W1 over the major portion of its length to a narrow end having a width W2. A first pair of openings 01 cooperates with openings (not shown) in secondary support stretcher 24 to receive a pivot pin (not shown). A second pair of openings 02 cooperates with openings (not shown) in main support stretcher 18 to receive a pivot pin (not shown). The pivot pins (not shown) inserted in the above-mentioned cooperating openings enable swinging movement of the connected elements relative to one another. Section 22-3 is provided with a pair of openings 03 that cooperate with openings (not shown) in rear rib 26. A pivot pin is inserted in the cooperating openings of elements 22-3 and 26 to enable swingable movement of the connected elements 22, 26 relative to one another. An end portion of rear rib can be seen to nest into section 22-3 when the umbrella is open.

The left-hand end of section 22-2 extends into the right-hand end of section 22-1 and the right-hand end of section 22-2 extends into the left-hand end of section 22-3. Sections 22-1 through 22-3, when joined, form a substantially straight, linear rib with the longitudinal axes of sections 22-1 through 22-3 lying substantially along a longitudinal common axis when rib is free from any bending forces. Section 22-1 has integral tabs T1 through T5 which wrap around section 22-2, as shown in FIG. 3. A forming tool (not shown) having a tapered end is forced against one sidewall of section 22-1 to form a small depression D1 in the sidewall, which in turn, is pressed into an adjacent surface of section 22-2, firmly securing sections 22-1 and 22-2 to one another. Tabs T1-T5 and the depression D1 in section 22-1 extending into section 22-2, cooperate to firmly secure sections 22-1 and 22-2 to one another and further prevent longitudinal movement of sections 22-1 and 22-2 relative to one another. The integral tabs T6 and T7 of section 22-3 wrap around section 22-2. Depressions D2 and D3, formed by the aforesaid forming tool, both pierce into section 22-2. Tabs T6-T7 and depressions D2, D3 cooperate to firmly secure sections 22-2 and 22-3 to one another and further prevent longitudinal movement of sections 22-2 and 22-3 relative to one another.

Rear rib 26 is preferably formed of an aluminum section 26-1, shown in dotted fashion in FIGS. 2-4, and a flexible fiberglass section 26-2.

In order to obtain optimum balance between the rigidity and structural strength of hybrid rib 22 to maintain inversions to an acceptable level and the flexibility and resilience to prevent permanent damage of the umbrella frame due to inversions, section 22-1 is formed of an aluminum alloy having a thickness TH preferably in the range of from 0.4<TH<0.9 mm and most preferably in the range of from 0.5 to 0.7 mm. The thickness of elements 18 and 20 are also preferably in the range of from 0.4<TH<0.9 mm and most preferably in the range of from 0.5 to 0.7 mm. The thickness range of section 22-3 may deviate from the most preferred thickness range set forth for section 22-1 and lie within the preferred thickness range. The length of section 22-3 is preferably less than the length of section 22-1.

The width W3 of rectangular-shaped, fiberglass section 22-2 is less than the width W1 of the section 22-1 to enable the section 22-2 to fit into the right-hand end of section 22-1. The thickness TH1 of section 22-1 is less than the width W3 to provide greater flexibility and resilience to forces which act on section 22-2 in a direction substantially parallel to the central, longitudinal axis of the main shaft direction and which cause inversion to enhance the ability of section 22-2 to resume its original shape when the inversion forces are removed. The ratio of thickness TH1 to width W3 of rectangular-shaped, fiberglass section is preferably in the range of from TH1=50% W3 to TH1=75% W3 and most preferably in the range of from TH1=60%W3 to TH1=70% W3. The length of section 22-3 relative to section 22-1 is preferably in the range of from 40% to 85% of the length of section 22-1 and most preferably in the range of from 50% to 60% of the length of section 22-1. In either case the length of section 22-3 is less than the length of section 22-1.

Section 22-1 provides the integrity needed to minimize inversion of the umbrella to an acceptable level when fully extended. Fiber glass reinforced plastic section 22-2 provides the flexibility to return the rib 22 back to its original shape when inversion forces are removed and thereby prevents rib 22 from experiencing distortion and permanent damage in the event of an inversion and further absorbs a significant amount of the force that would otherwise be transferred to the main stretcher 18 and rear rib 26 by an all-aluminum rib. Section 22-3 attaches the composite rib 22 to the adjoining last or rear rib 26. Hybrid rib 22 thus protects elements 18, 20, 24 and 26 from permanent damage by absorbing the forces experienced due to inversion.

What is claimed is:

1. A frame (10) for a compact, folding umbrella having multiple folds, comprising in combination:

a main shaft (12) having a handle (21*b*) at a lower end;

a collar (16) slidably mounted on said main shaft (12);

a cap (14) mounted on an upper end of the main shaft (12);

a main stretcher (18) having one end pivotally coupled to said cap (14);

a support stretcher (20) having one end (20*a*) pivotally coupled to said collar (16) and another end (20*b*) pivotally coupled to an intermediate portion of the main stretcher (18);

a rear rib (26);

a hybrid rib (22) pivotally coupled to another end of said main stretcher 18 and to an inner end of said rear rib (26);

said hybrid rib (22) being formed of first, second and third sections (22-1, 22-3, 22-2);

a flexible member (28) having one end (28*a*) coupled to the main stretcher (18) and another end coupled to the rear rib (26) for extending the rear rib (26) when the frame (10) is opened;

said first and second end sections (22-1 and 22-3) having outer ends configured to define the ends pivotally coupled to the main stretcher (18) and rear rib (26);

said third section (22-2) being positioned between said first and second sections (22-1 and 22-3) and having first and second ends that are respectively joined to an inner end of said first section (22-1) and an inner end of said second section (22-3), to render the hybrid rib (22) straight and linear;

the first and second sections (22-1 and 22-3) being U-shaped in cross section and formed of aluminum;

the first section (22-1) having an aluminum wall thickness (th) in a range of 0.5 mm to less than 0.8 mm and having a selected length, and the third section (22-2) being formed of fiberglass and having a length less than the length of the first section (22-1) wherein the third section absorbs forces occurring during multiple inversions of the folding umbrella, allowing the folding umbrella to be repeatably restored to an original undamaged condition from an inverted condition by sliding the collar (16) down the main shaft (12) toward the handle (12*b*);

whereby, the hybrid rib (22) protects the combination from permanent damage by absorbing forces experienced due to inversions of the folding umbrella.

2. The frame of claim 1 wherein the thickness (TH) of the third section (22-2) is 50% to 75% of the width (W) of the third section (22-2).

3. The frame of claim 2 wherein the thickness (TH) of the third section (22-2) is 60% to 70% of the width (W) of the third section (22-2).

4. The frame of claim 1 wherein the length of the third section (22-2) relative to the first section (22-1) is in a range of 40% to 85% of the length of the first section (22-1).

5. The frame of claim 4 wherein the length of the third section (22-2) is 40% of the length of the first section (22-1).

6. The frame of claim 1 wherein the third section (22-2) is formed of fiberglass and has a rectangular, cross-sectional shape, a perimeter of the third section (22-2) being defined by a pair of parallel sides (22-*w*) and a pair of parallel edges (22-*e*), said edges (22-*e*) having a thickness (TH) less than a width (W) of the sides of the third section;

the third section (22-2) being oriented so that the third section (22-2) experiences greater bending when a force of a given magnitude is applied to one of the sides than a bending of the third section when a force of like magnitude is applied to one of said edges, enabling the rib (22) to resume a unstressed linear state without distortion when said force is removed;

the first and second ends of the third section (22-2) extending into the inner ends of the first (22-1) and second (22-3) sections, respectively.

7. The frame of claim 1 wherein the wall thickness (th) is in a range of 0.5 mm to 0.7 mm.

8. The frame of claim 1 wherein the wall thickness (th) is in a range of 0.6 mm to 0.7 mm.

9. The frame of claim 1 wherein the wall thickness is 0.7 mm.

10. The frame of claim 1 wherein the wall thickness is 0.6 mm.

11. The frame of claim 1 wherein the wall thickness is 0.5 mm.

* * * * *